US006999590B2

(12) United States Patent
Chen

(10) Patent No.: US 6,999,590 B2
(45) Date of Patent: Feb. 14, 2006

(54) STEREO SOUND CIRCUIT DEVICE FOR PROVIDING THREE-DIMENSIONAL SURROUNDING EFFECT

(75) Inventor: Chien Cheng Chen, Kaohsiung (TW)

(73) Assignee: Sunplus Technology Co., Ltd., Hsin-Chu (TW)

( * ) Notice: Subject to any disclaimer, the term of this patent is extended or adjusted under 35 U.S.C. 154(b) by 819 days.

(21) Appl. No.: 09/907,677

(22) Filed: Jul. 19, 2001

(65) Prior Publication Data

US 2003/0016837 A1 Jan. 23, 2003

(51) Int. Cl.
*H04R 5/00* (2006.01)

(52) U.S. Cl. ..... 381/1; 381/17; 381/18; 381/98

(58) Field of Classification Search ..... 381/1, 381/17, 18, 19, 27, 98
See application file for complete search history.

(56) References Cited

U.S. PATENT DOCUMENTS 4,394,536 A * 7/1983 Shima et al. ..... 381/1
5,384,851 A * 1/1995 Fujimori ..... 381/17
5,657,391 A * 8/1997 Jyosako ..... 381/1
6,498,856 B1 * 12/2002 Itabashi et al. ..... 381/302
6,597,791 B1 * 7/2003 Klayman ..... 381/1

* cited by examiner

*Primary Examiner*—Sinh Tran
*Assistant Examiner*—Justin Michalski
(74) *Attorney, Agent, or Firm*—Bacon & Thomas, PLLC

(57) ABSTRACT

A stereo sound circuit device for providing three-dimensional surrounding effect has a difference circuit for acquiring difference signal of a left channel sound and a right channel sound. The stereo sound circuit device further provides a filter circuit consisting of a first and a second filtering operation units for applying a first and second filtering functions to the difference signal output from the difference circuit for generating a three-dimensional surrounding sound signal. The first filtering function implements a band pass filter with a central frequency of about 7.23 KHz. The second filtering function implements a band pass filter with a central frequency of about 318 Hz. A signal level adjust circuit is provided for adjusting the signal level of the sound signal output from the filter circuit. A mixer is provided for combining the adjusted three-dimensional surrounding sound with the original left channel sound and right channel sound.

11 Claims, 5 Drawing Sheets

STEREO SOUND CIRCUIT DEVICE FOR PROVIDING THREE-DIMENSIONAL SURROUNDING EFFECT

BACKGROUND OF THE INVENTION

1. Field of the Invention

The present invention pertains to generating electronic sound. More particularly, the present invention relates to a stereo sound circuit device for providing three-dimensional surrounding sound effect.

2. Description of Related Art

With the progress of electronic technology and the widely spread use of the multi-media, the three-dimensional surrounding sound can be implemented by enhancing the stereo sound effect. That is, with only a pair of speakers or earphones, the listener may hear the sound coming from various directions in the space. Therefore, the realistic feeling of the music can be increased. Furthermore, the realistic hearing enjoyment can be provided with the use of an electronic sound generating device, such as a multimedia computer or a virtual reality helmet.

Generally, the three-dimensional surrounding sound is implemented by the HRTF (Head Related Transfer Function) measurement. The HRTF refers to a process that a sound from a specific sound source transfers to the drum of the ear. Due to the resonance and diffraction effects of the pinna structure, shoulder and torso, a filtering effect is thus applied to the sound wave. Therefore, the HRTF at a specific position can be presented by a pair of impulse responses to the drums of two ears or microphones in two ears of a simulated head. The pair of impulse responses includes the frequency responses, the relative time differences, and the relative strength differences corresponding to the two ears.

In order to generate a three-dimensional sound effect, a digital filter with time delay must be made by software or hardware. As shown in FIG. 5, the signals of the left ear and right ear are respectively processed by a finite impulse response digital filter and a time delay element, so as to provide the HRTF effect and add the three-dimensional surrounding sound. However, although the added surrounding sound may generate a three-dimensional surrounding effect, the original sound may be distorted. Therefore, there is a demand to have a novel sound device capable of providing the three-dimensional surrounding sound effect, while the original sound is almost not distorted.

SUMMARY OF THE INVENTION

Accordingly, the primary object of the present invention is to provide a stereo sound circuit device for effectively providing three-dimensional surrounding sound effect without distorting the original sound.

In order to achieve the object, the stereo sound circuit device in accordance with the present invention includes a difference circuit, a filter circuit, a signal level adjust circuit, and a mixer. The difference circuit is provided for acquiring difference signal of a left channel sound and a right channel sound. The filter circuit has a first and a second filtering operation units for applying a first and second filtering functions to the difference signal output from the difference circuit for generating a three-dimensional surrounding sound signal. The first filtering function implements a band pass filter with a central frequency of about 7.23 KHz. The second filtering function implements a band pass filter with a central frequency of about 318 Hz. The signal level adjust circuit is provided for adjusting the signal level of the sound signal output from the filter circuit. The mixer is provided for combining the adjusted three-dimensional surrounding sound with the original left channel sound and right channel sound.

The various objects and advantages of the present invention will be more readily understood from the following detailed description when read in conjunction with the appended drawing.

DETAILED DESCRIPTION OF THE PREFERRED EMBODIMENTS

Figure 1:
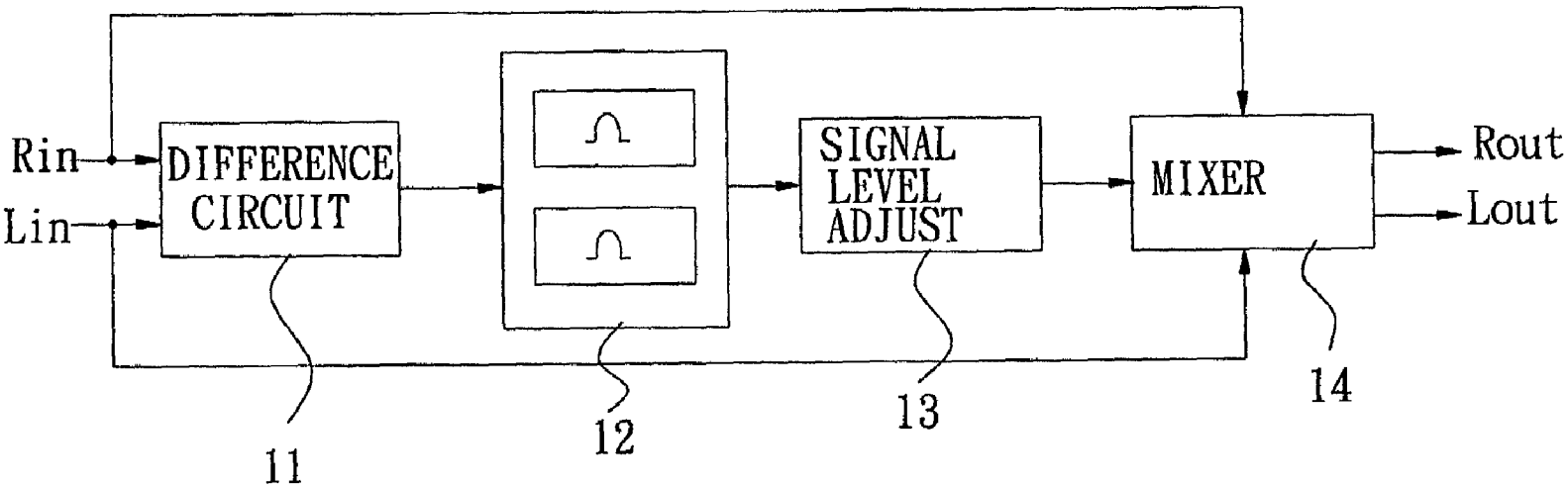
FIG. 1 is a functional block diagram of the stereo sound circuit device for providing three-dimensional surrounding effect in accordance with the present invention.

With reference to the functional block diagram of FIG. 1, a stereo sound circuit device for providing three-dimensional surrounding sound effect in accordance with a preferred embodiment of the present invention is shown. The circuit device includes a difference circuit 11, a filter circuit 12, a signal level adjust circuit 13, and a mixer 14. The sounds from the left input channel (Lin) and right input channel (Rin) are processed by the difference circuit 11. The resultant difference signal is applied to the filter circuit 12 for being processed by HRTF to generate a three-dimensional surrounding sound signal, which is then processed by the signal level adjust circuit 13 to adjust the signal level of the sound signal. The level-adjusted three-dimensional surrounding sound is further applied to the mixer for combining with the original sounds from the left input channel and right input channel for output.

Figure 2:
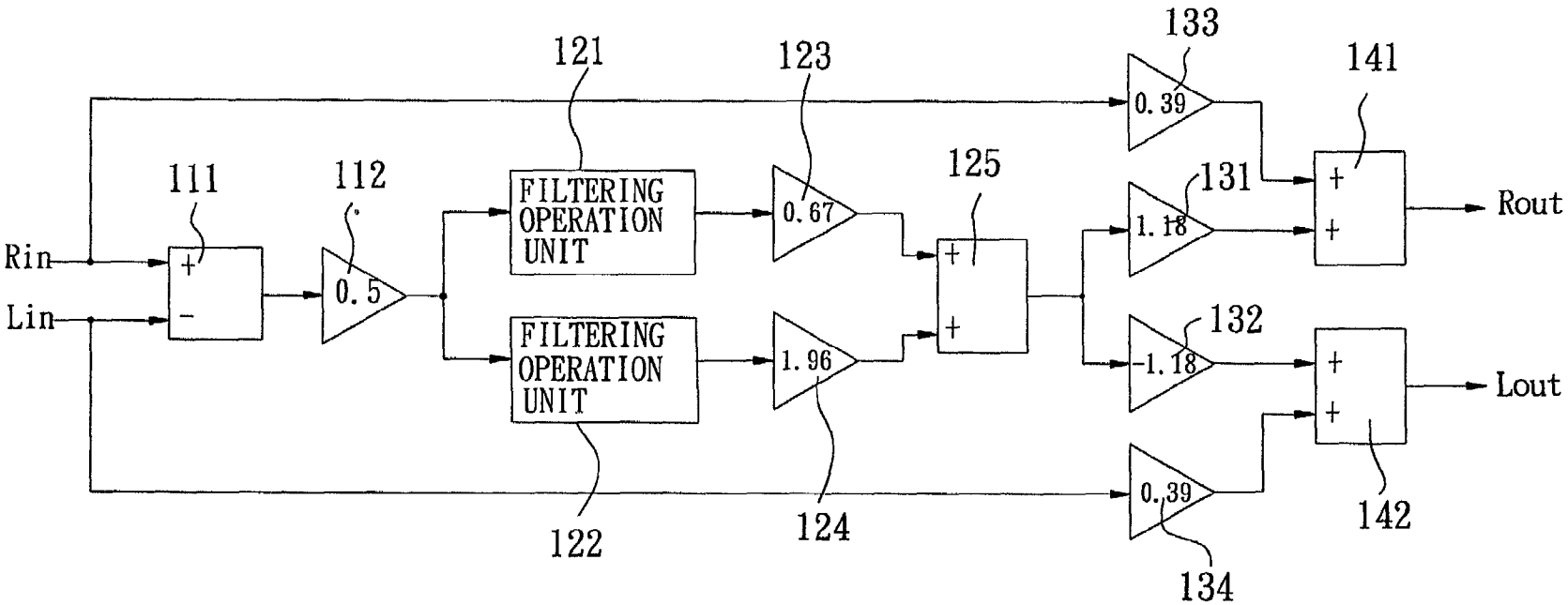
FIG. 2 is a circuit block diagram of the stereo sound circuit device for providing three-dimensional surrounding effect in accordance with the present invention.

The circuit structure and the operation of the above stereo sound circuit device for providing three-dimensional surrounding sound effect are illustrated in FIG. 2. The difference circuit 11 consists of a subtractor 111 and an amplifier 112 connected in series, so as to acquire a difference sound signal of the left and right channels, and apply a gain value of, for example, 0.5 to the difference sound signal for adjusting its gain. The filter circuit 12 includes two filtering operation units 121 and 122 for applying a first filtering function and a second filtering function to the difference sound signal output from the amplifier 112. The first filtering function is preferably represented as $$\frac{45454S}{S^2 + 22727S + 2066115702},$$

which can implement a band pass filter with a central frequency of 7.23 KHz. The second filtering function is preferably represented as $$\frac{2000S}{S^2+1000S+4000000},$$

which can implement a band pass filter with a central frequency of 318 Hz. As such, the filter circuit 12 performs filtering operations to change the frequency amplitude and phase of the difference sound signal for generating three-dimensional surrounding effect. The output signals of the first and second filtering operation units 121 and 122 are further processed by the amplifiers 123 and 124 for applying gain values of, for example, 0.67 and 1.96, to the two output signals to adjust their gains, respectively. The gain-adjusted output signals are then added together by the adder 125.

The signal level adjust circuit 13 includes two amplifiers 131 and 132 for adjusting the gain of the output signal of the adder 125 with opposite gain values of, for example, 1.18 and −1.18. In addition, the signal level adjust circuit 13 further includes two amplifiers 133 and 134 for adjusting the gains of the original left channel and right channel sounds with the same gain value of, for example, 0.39.

The mixer 14 includes two adders 141 and 142. The adder 141 is provided to combine the output signals from the amplifier 133 and 131 for generating an output sound signal on the right output channel (Rout), and the adder 142 is provided to combine the output signals from the amplifiers 134 and 132 for generating an output sound signal on the left output channel (Lout).

Figure 3:
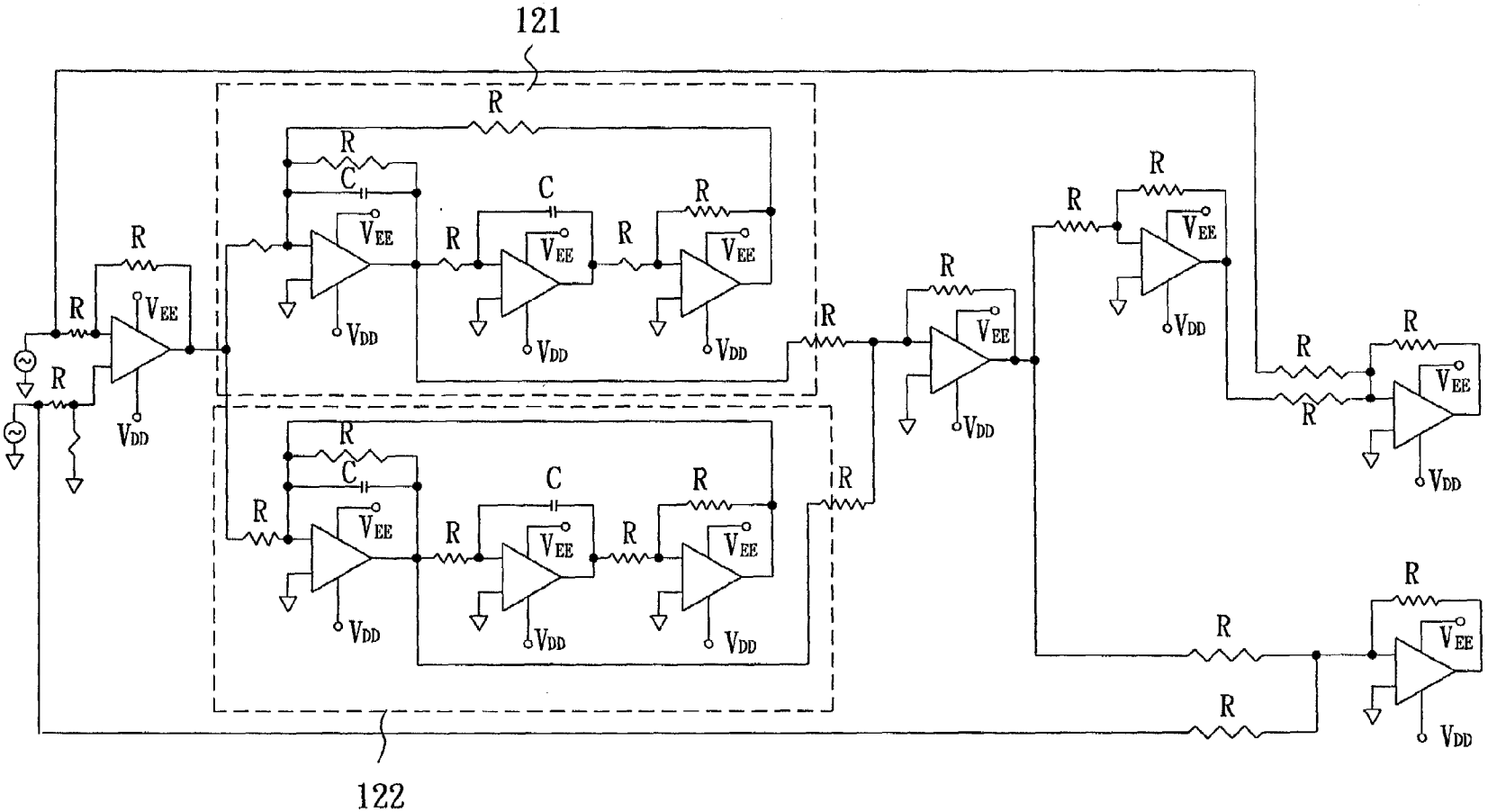
FIG. 3 is a schematic diagram of the stereo sound circuit device for providing three-dimensional surrounding effect in accordance with the present invention.

FIG. 3 shows that the stereo sound circuit device for providing three-dimensional surrounding sound effect in accordance with the present invention can be implemented by operational amplifiers. As shown, each of the first and second filtering operation units 121 and 122 can be implemented by three operational amplifiers with several resistors and capacitors, so as to achieve the required filtering functions.

Figure 4:
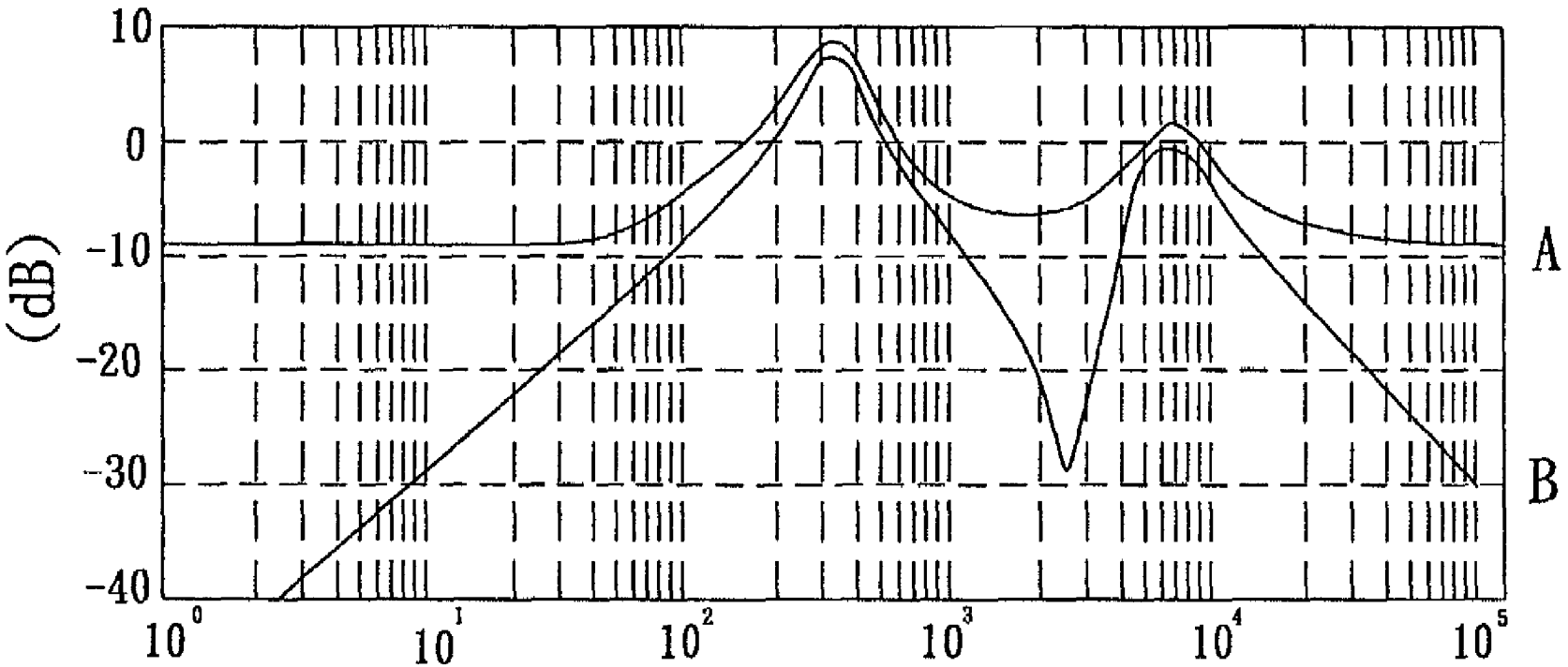
FIG. 4 is a Bode diagram showing the frequency response of the stereo sound circuit device for providing three-dimensional surrounding effect in accordance with the present invention.
Figure 5:
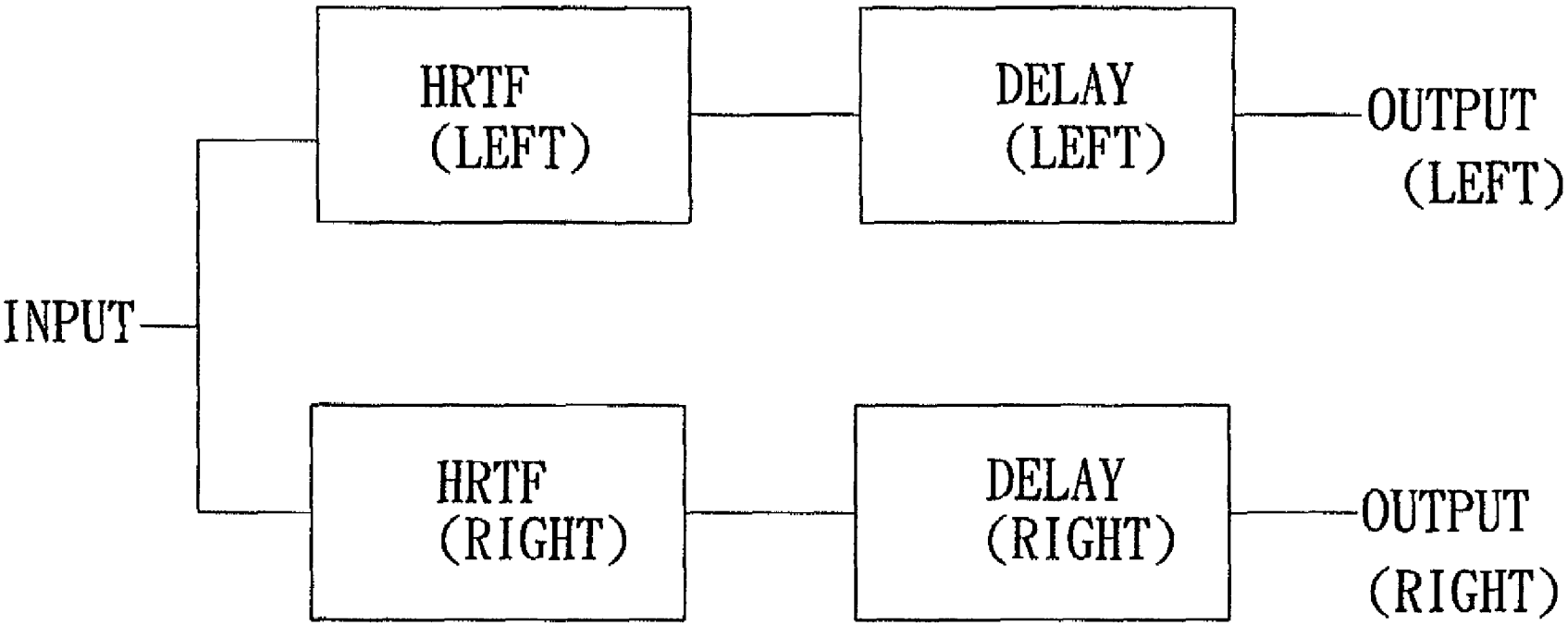
FIG. 5 PRIOR ART
FIG. 5 schematically illustrates the conventional technique for generating a three-dimensional surrounding sound effect.

A realistic three-dimensional surrounding sound effect can be acquired through the use of the above stereo sound circuit device. FIG. 4 illustrates a Bode diagram, which depicts the frequency response of the stereo sound circuit device of the present invention in a filtering process, wherein the waveform A represents the sound transferred from a left speaker to the left ear of a listener, and the waveform B represents the sound transferred from a right speaker to the right ear. With the knowledge of the first and second filtering functions and the circuit, it is known that the amplitude of the sound signal is amplified at a low frequency of about 318 Hz, and the amplitude of the sound signal at a high frequency of about 7.23 KHz is slightly amplified. As such, since sound is less sensitive to the direction in low frequency, a three-dimensional surrounding sound can be effectively generated without distorting the original sound by amplifying the amplitude of the sound signal at a low frequency of about 318 Hz to produce surrounding sound effect. Furthermore, the sound at a high frequency of about 7.23 KHz generally refers to the background music, and thus, a little amplification to the sound is performed, so as to avoid the attenuation of the sound and also achieve the effect of generating a three-dimensional surrounding sound without distorting the original sound. In addition, as to the circuit implementation, although the central frequency and the corresponding amplitude of the stereo sound circuit device may have some variations due to the possible errors of the resistors and capacitors in the circuit, it is appreciated that the stereo sound circuit device can present satisfactory three-dimensional surrounding sound effect if the variation of the central frequency and the amplitude at the central frequency is within the range of ±5%.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A stereo sound circuit device for providing three-dimensional surrounding sound effect, comprising:

a subtractor for concurrently receiving a left channel sound and a right channel sound, thereby performing a subtraction operation to acquire a difference signal of the left channel sound and the right channel sound;

a difference amplifier connected in series to the subtractor for amplifying the difference signal;

a filter circuit having first and a second filtering operation units for applying first and second filtering functions to the difference signal output from the difference amplifier for generating a three-dimensional surrounding sound signal, wherein the first filtering function implements a band pass filter with a central frequency of 7.23 KHz, and the second filtering function implements a band pass filter with a central frequency of 318 Hz;

a signal level adjust circuit for adjusting the signal level of the sound signal output from the filter circuit; and a mixer for combining the adjusted three-dimensional surrounding sound with the original left channel sound and right channel sound.

2. The stereo sound circuit device as claimed in claim 1, wherein the first filtering function is represented as $$\frac{45454S}{S^2+22727S+2066115702}.$$

3. The stereo sound circuit device as claimed in claim 1, wherein the second filtering function is represented as $$\frac{2000S}{S^2+1000S+4000000}.$$

4. The stereo sound circuit device as claimed in claim 1, wherein the amplifier has a gain of 0.5.

5. The stereo sound circuit device as claimed in claim 1, wherein the filter circuit further comprises:

a first amplifier for adjusting output signal of the first filtering operation unit;

a second amplifier for adjusting output signal of the second filtering operation unit; and an adder for adding outputs of the first and second amplifier.

6. The stereo sound circuit device as claimed in claim 5, wherein the first amplifier has a gain of 0.67 and the second amplifier has a gain of 1.96.

7. The stereo sound circuit device as claimed in claim 1, wherein the signal level adjust circuit comprises:

a first amplifier and a second amplifier for adjusting a gain of output signal of the filter circuit with opposite gain values, said two gain device have gains with opposite gain values; and a third amplifier and a fourth amplifier for adjusting gains of the original left channel sound and right channel sound with the same gain value.

8. The stereo sound circuit device as claimed in claim 7, wherein the first amplifier has a gain of 1.18 and the second amplifier has a gain of −1.18.

9. The stereo sound circuit device as claimed in claim 7, wherein the third amplifier and the fourth amplifier have an identical gain value of 0.39.

10. The stereo sound circuit device as claimed in claim 7, wherein the mixer comprises:

a first adder for adding output signals from the third and the first amplifiers to generate right channel output sound signal; and a second adder for adding output signals from the fourth and the second amplifiers to generate left channel output sound signal.

11. The stereo sound circuit device as claimed in claim 7, wherein the central frequency and the amplitude at the central frequency of the band pass filter are allowed to have a variation of ±5%.

* * * * *